US005188450A

United States Patent [19]

Anderson

[11] Patent Number: 5,188,450

[45] Date of Patent: Feb. 23, 1993

[54] CUSHION GRIP AND SPARE BATTERY HOLDER FOR FLASHLIGHT

[76] Inventor: George Anderson, 1002 14th St., SW., Sidney, Mont. 59270

[21] Appl. No.: 764,639

[22] Filed: Sep. 24, 1991

[51] Int. Cl.[5] ..... F21L 7/00; F21L 15/06

[52] U.S. Cl. ..... 362/194; 362/189; 362/190; 362/202; 206/573

[58] Field of Search ..... 362/190, 189, 194, 202, 362/204, 206, 208, 253, 457, 191; 206/573, 333; 220/555

[56] References Cited

U.S. PATENT DOCUMENTS

| | | | |
|---|---|---|---|
| 1,403,707 | 1/1922 | Quarnstrom | 362/396 |
| 1,788,277 | 1/1931 | Cornell | 362/204 |
| 2,001,363 | 5/1935 | Joers | 362/204 |
| 2,080,583 | 5/1937 | Stimson | 362/205 |
| 2,082,676 | 6/1937 | Beiler | 362/191 |
| 2,541,941 | 2/1951 | Shenk | 362/202 |
| 3,307,026 | 2/1967 | Kramer | 362/191 |
| 3,393,311 | 7/1968 | Dahl | 362/190 |
| 4,415,954 | 11/1983 | Schaefer | 362/202 |
| 4,709,309 | 11/1987 | Yamaki | 362/199 |
| 4,750,095 | 6/1988 | Huang | 362/190 |
| 4,754,379 | 6/1988 | Kelley | 362/202 |
| 4,823,244 | 4/1989 | Alaybayoglu et al. | 362/202 |
| 4,897,768 | 1/1990 | Thul | 362/191 |
| 4,980,805 | 12/1990 | Maglica | 362/72 |

*Primary Examiner*—Ira S. Lazarus
*Assistant Examiner*—Y. Quach

[57] ABSTRACT

A cushion grip and spare battery holder is provided comprising a first piece with two receptacles. The first receptacle retains a flashlight, the second receptacle is designed to retain a spare battery within it. The invention also provides a hood which covers the end of a flashlight which houses the bulb and reflector.

9 Claims, 1 Drawing Sheet

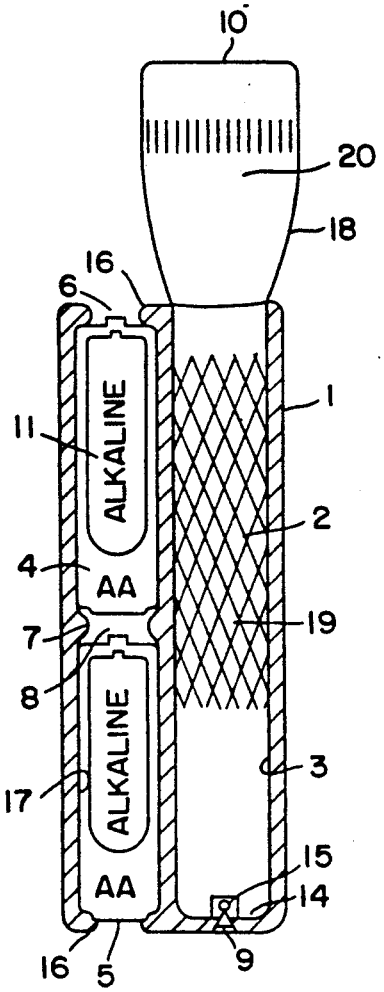
FIG.1
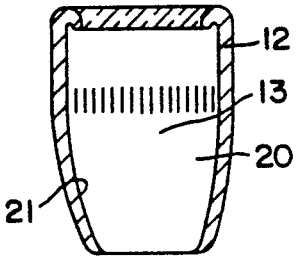
FIG.2
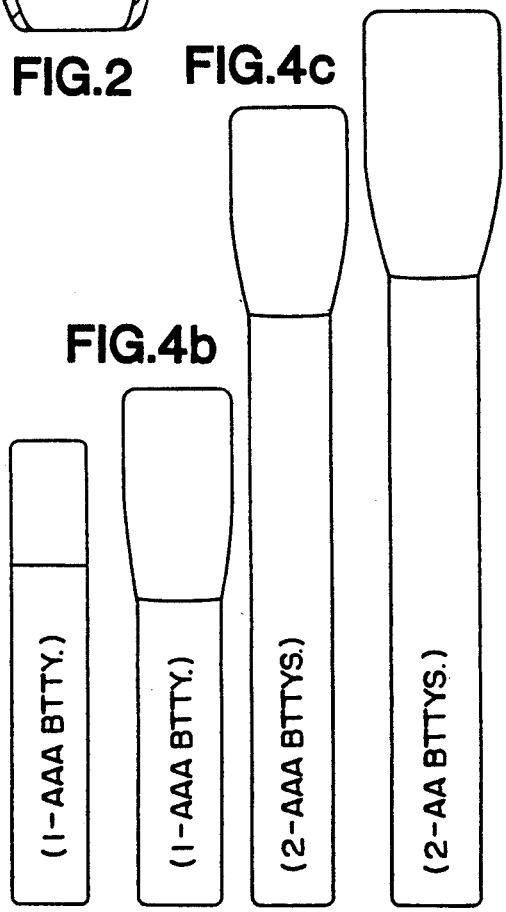
FIG.4c
FIG.4b
FIG.4a
FIG.4d
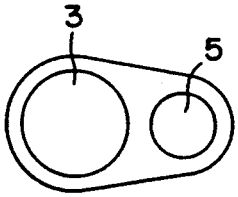
FIG.3a
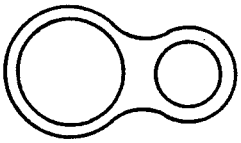
FIG.3b
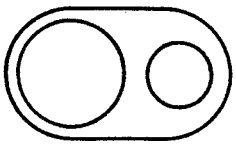
FIG.3c

CUSHION GRIP AND SPARE BATTERY HOLDER FOR FLASHLIGHT

FIELD OF THE INVENTION

The present invention relates to a device to be placed onto a flashlight for allowing the user to more easily, safely and comfortably handle the flashlight and to carry spare batteries with the flashlight.

BACKGROUND OF THE INVENTION

Flashlights commonly available on the market often consist of a round tube containing batteries and a light bulb. Often, flashlights lack features and characteristics necessary to make then function well in ways commonly used. For instance, since flashlights are often round in cross section they tend to roll when placed on a surface, making it difficult to maintain constant illumination on a subject. Therefore, people have created devices to meet the needs of flashlight users.

Attachment devices for flashlights are known and available on the market which allow the user to carry items, such as a Thermos bottle, in addition to the flashlight and/or to hold a flashlight fixed to a stationary object to free the hands of the user. Additionally, flashlights exist which have a cushion grip to make handling the flashlight easier and safer. Also, flashlights exist which contain within the body of the flashlight compartments providing a means for the carrying of spare batteries. However, no known device provides a flashlight holder which incorporates all of the above functions and can be used interchangeably with different flashlights.

SUMMARY OF THE INVENTION

The present invention overcomes the shortcomings existing in the prior art.

Among the objects of the present invention is to provide an attachment for a flashlight made of a material having elastic characteristics, such as rubber, dense polymeric foam, or plastic. The present invention allows the user to grip the flashlight more securely and more comfortably.

Another object of the present invention is to provide cover for a flashlight to protect a flashlight's finish.

A further object of the present invention is to provide a device to hold both a flashlight as well as at least one spare battery for the flashlight.

A still further object of the present invention is to provide a holder for a flashlight which prevents the flashlight from rolling about when the flashlight is laid upon a surface.

A still further object of the present invention is to provide a hood to cover the end of the flashlight. An additional object of the present invention is to increase the safety of the user by insulating the metallic flashlight body from electrical sources as well as protecting the user from the hot or cold metallic surface of the flashlight. A still further object of the present invention is to provide a covering for a flashlight to allow the flashlight to be gripped in the mouth of the user. The present invention provides all of the above functions and can be used interchangeably with separate flashlights because it is not fixably attached to a single flashlight.

The above and other advantages of the present invention are achieved by the structure as described below. The present invention provides a flashlight cushion grip and spare battery holder made of a material having elastic, non-electrically conducting and heat insulating characteristics, such as rubber, dense polymeric foam, or plastic. The flashlight holder includes a first receptacle for holding a flashlight and a second receptacle for holding at least one spare battery for the flashlight. The receptacles of the flashlight holder are designed to have corresponding sizes slightly smaller than the flashlight and battery, such that the elasticity of the material retains the flashlight and battery in the receptacles by friction. The present invention device may also include a hood portion designed to be placed over the end of the flashlight which houses the bulb and reflector. The hood portion is separate from the flashlight holder member. The hood portion serves the same functions as the flashlight holder member, especially in that it covers the remaining exposed portion of a flashlight left uncovered by the first part of the invention.

BRIEF DESCRIPTION OF THE DRAWINGS

The objects of the present invention are shown in the accompanying drawings in which:

FIG. 1 shows a cross sectional view of one embodiment of the present invention device with the flashlight and spare batteries retained therein;

FIG. 2 shows a cross sectional view of the hood piece of the invention;

FIG. 3A, 3B, 3C show an overhead view of three possible cross-sectional configurations of the present invention device; and FIG. 4A, 4B, 4C, 4D show a cross sectional view of four sizes of the flashlight which different embodiments of the invention could be designed to hold, together with various numbers of spare batteries.

DETAILED DESCRIPTION OF THE PREFERRED EMBODIMENTS

The present invention device comprises flashlight cushion grip and spare battery holder 1 designed to receive a flashlight 10 and at least one spare battery for the flashlight. The flashlight holder can be made of a single piece of material having elastic and heat and electrical insulating properties and defining a first receptacle and a second receptacle. The receptacles in the present invention flashlight holder retain the flashlight and at least one battery.

The present invention flashlight holder may also comprise a hood made of the same material as the flashlight holder. The hood fits over the end of the flashlight housing the bulb and reflector.

FIG. 1 shows the present invention flashlight holder 1 with a flashlight 10 and spare batteries 11 placed therein. The flashlight 10 is placed into the first receptacle 2. The inner surface 3 of the first receptacle 2 substantially corresponds to the size and shape of a handle portion 19 of the flashlight 10. Further, the inside diameter of the first receptacle 2 is smaller than the outside diameter of the flashlight handle 19 to be placed within it. Because the present invention flashlight holder has elastic characteristics and is slightly smaller than the outside diameter of the flashlight, the flashlight will be held in the first receptacle by friction.

At least one hole 9 formed at the base of the first receptacle 2 allows a cord or wire to be attached to an existing hole 15 in the base 14 of the flashlight 10.

The second receptacle 4 holds at least one spare battery 11 to b used in the flashlight (10) held in the first receptacle. The second receptacle (4) has two openings, a first opening formed at the top end (6) of the receptacle and a second opening (5) at the bottom end of the receptacle. The inside diameter of the second receptacle (4) is designed to be smaller than the outside diameter of the battery to be placed within it. Therefore, the size of the second receptacle as well as the elastic nature of the material used to form the present invention help to retain the battery by friction.

The first opening 6 and second opening 5 of the second receptacle each have a lip (16) partially extending into the opening. These lips (16) ensure that a battery (11) will be retained within the second receptacle (4). Further, in an embodiment designed to be used with a flashlight using, for example, two batteries, a ring 7 formed on the inside wall (17) of the second receptacle 4, midway between the two openings of the second receptacle (4) creates a hole (8) between the batteries (11) ensuring that the batteries (11) in the second receptacle (4) will be maintained separate from each other to avoid any possible shorting or drainage of power. Embodiments to be used with flashlights using more batteries have one of these rings formed on the inside wall wherever two batteries could possibly come into physical contact.

The present invention further comprises a hood 12 designed to be placed over the end of the flashlight 11 housing the bulb and reflector. The hood is constructed of a material similar to that of the first piece. The inside surface 28 of the hood substantially corresponds to the size and shape of the outside surface 18 of the end (20) of the flashlight (10) which houses the bulb and reflector. The inner surface 21 of the hood encloses a space 13 smaller than the space defined by the bulb and reflector housing. Therefore, friction will cause the hood to be retained on the flashlight.

The present invention is inexpensively manufactured due to its simplicity of design. Additionally, the invention can be manufactured to hold a variety of sizes of flashlight using varying battery sizes and numbers of batteries. FIG. 3 shows three possible configurations among the many available for the cross section of the cushion grip. These configurations vary in the thickness of the material forming the two receptacles as well as the thickness of the material joining the cylinders. The invention can be designed and manufactured to hold various sizes flashlights, as shown in FIG. 4, with varying numbers of batteries as well as various diameters and lengths of flashlights.

Although the principles of the present invention have been described with reference to a particular embodiment, by way of example, it is understood that modifications may suggest themselves to those skilled in the art and it is intended that such modifications fall within the scope of the claims.

We claim:

1. A flashlight holder having a cushion grip and spare battery holder comprising a single member made of a non-electrically conducting material having elastic characteristics, said single member defining a first receptacle and a second receptacle, said first receptacle having a shape substantially corresponding to that of the outside surface of a flashlight and a size slightly smaller than the outside surface of the flashlight, such that the elastic material would retain the flashlight within the receptacle by friction, said first receptacle further having an opening through which the flashlight is inserted;

said second receptacle having a shape substantially corresponding to that of the outside surface of at least one battery used to power the flashlight and a size slightly smaller than that of the battery such that the elastic material would retain the battery within the receptacle by friction;

said second receptacle having a first opening and a second opening through which said battery is inserted into the second receptacle.

2. The flashlight holder according to claim 1, further comprising at least one hole in the first receptacle, at or near an end of the flashlight holder opposite the opening where the flashlight is inserted, said hole being designed to receive a cord or wire which attaches to an existing hole in the base of the flashlight.

3. The flashlight holder according to claim 1 wherein the second receptacle is adapted to retain one spare battery.

4. The flashlight holder according to claim 1 wherein the second receptacle is adapted to retain two spare batteries.

5. The flashlight holder according to claim 4, wherein the second receptacle has a ring formed on the inside surface to keep the spare batteries out of physical contact.

6. The flashlight holder according to claim 1 wherein the openings of the second receptacle have a lip formed around their edges and extending over the openings, partially covering the openings.

7. The flashlight holder according to claim 1, the second receptacle is adapted to hold more than two batteries and includes plurality of rings formed on the inside wall of the receptacle at locations where the batteries would meet to maintain the batteries out of physical contact.

8. The flashlight holder according to claim 1, further comprising a hood made of a single piece of a non-electrically conducting material having elastic characteristics said hood having a shape substantially corresponding to the outside surface of the end of a flashlight housing the bulb and reflector and a size slightly smaller than that of the end of the flashlight such that the hood would be retained on the flashlight by friction.

9. A flashlight holder having a cushion grip and spare battery holder comprising a member made of material having elastic characteristics and comprised of two interconnected cylinders, the cylinders defining a first receptacle and a second receptacle, the first receptacle having a shape substantially corresponding to that of the outside surface of a flashlight and a size slightly smaller than the outside surface of the flashlight, such that the elastic material would retain the flashlight within the receptacle by friction;

said first receptacle having an opening formed at an end of the receptacle for the insertion of the flashlight;

said second receptacle having a shape substantially corresponding to that of the outside surface of at least one battery used to power the flashlight and a size slightly smaller than the battery such that the elastic material would retain the battery within the receptacle by friction;

said second receptacle having a first opening and a second opening for insertion of the battery.

* * * * *